US008297014B2

(12) United States Patent
Hanumantrao

(10) Patent No.: US 8,297,014 B2
(45) Date of Patent: Oct. 30, 2012

(54) ARCHITECTURAL STRUCTURE AND METHOD THEREOF

(76) Inventor: Jadhav Uttamrao Hanumantrao, Maharashtra (IN)

( * ) Notice: Subject to any disclaimer, the term of this patent is extended or adjusted under 35 U.S.C. 154(b) by 12 days.

(21) Appl. No.: 12/808,714

(22) PCT Filed: Jul. 9, 2008

(86) PCT No.: PCT/IN2008/000437

§ 371 (c)(1), (2), (4) Date: Jun. 17, 2010

(87) PCT Pub. No.: WO2009/078032

PCT Pub. Date: Jun. 25, 2009

(65) Prior Publication Data

US 2010/0287850 A1 Nov. 18, 2010

(30) Foreign Application Priority Data

Dec. 18, 2007 (IN) ..... 2486/MUM/2007

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl. ..... 52/236.4

(58) Field of Classification Search ..... 52/40, 79.1, 52/79.2, 236.4, 169.1; 210/150, 167.01, 210/195.1

See application file for complete search history.

(56) References Cited

U.S. PATENT DOCUMENTS

| | | | | |
|---|---|---|---|---|
| 2,698,973 | A * | 1/1955 | Zeckendorf et al. | 52/185 |
| 3,331,168 | A * | 7/1967 | Frey | 52/73 |
| 4,035,973 | A | 7/1977 | Suteland | |
| 2005/0138867 | A1 * | 6/2005 | Zhao | 52/79.1 |
| 2009/0193732 | A1 * | 8/2009 | Clark et al. | 52/236.4 |
| 2010/0288264 | A1 * | 11/2010 | Zhang | 126/563 |
| 2012/0124934 | A1 * | 5/2012 | Baugh et al. | 52/741.15 |

FOREIGN PATENT DOCUMENTS

| | | |
|---|---|---|
| CN | 1066705 | 12/1992 |
| CN | 1439792 | 3/2003 |
| CN | 1420249 | 5/2003 |
| CN | 1811084 | 8/2006 |

OTHER PUBLICATIONS

CN1811084A—Translation.*

* cited by examiner

*Primary Examiner* — Brian Glessner
*Assistant Examiner* — Paola Agudelo
(74) *Attorney, Agent, or Firm* — Cowan, Liebowitz & Latman, P.C.; Mark Montague, Esq.

(57) ABSTRACT

An architectural structure comprises a core column structure (1), a plurality of recessed platform structures (2) vertically spaced apart from each other and supported by the column structure, and landfill filled in the recessed platform structures form plots. A water reticulation system moves through all the plots from a central water supply system. Dwellings (4) are built on the plots.

24 Claims, 18 Drawing Sheets

ARCHITECTURAL STRUCTURE AND METHOD THEREOF

FIELD OF THE INVENTION

Figure 1:
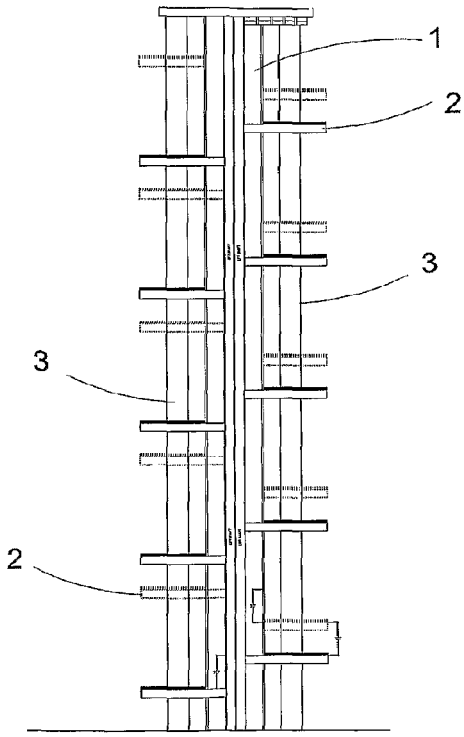

This invention relates to an architectural concept.

BACKGROUND OF THE INVENTION

Herein after in the specification housing structure means a dwelling unit, a commercial space, a stadium, parking lot and the like.

Also agricultural or horticultural use extends to use of the plots for cultivation of plants, vegetables, fruits, flowers and the like. It also includes the growing of plants in a green house.

Space constraint in urban areas compels families to stay in cramped dwelling units without much openness, inadequate ventilation and insufficient illumination. Absence of east-west opening doors and windows, use of electric illuminators during day hours, fans and air-conditioners running even in winter season are routine matters. Such dwelling units just provide shelter and are far from desirable! One and only reason is the absence of openness i.e. vacant space around houses.

Breeze & nature's other valuable gifts including Oxygen required for human survival are scarce in the urban area. It is not far when urban population will be buying Oxygen for their survival. In fact trees, bushes & creepers and even the tiniest grass provide good amounts of oxygen and create an atmosphere which strikes an ecological balance. Greenery is more necessary in urban areas to mitigate the wrong done by industrial & vehicular pollution. Small plants and creepers in small pots or in balconies in an attempt to quench thirst for greenery is not only pitiable but is also not enough to undo the wrong done.

A single house on a big plot seen in villages or in small towns and few bungalows/villas in metropolitan cities such as for Ministers and senior bureaucrats provide outstandingly good atmosphere, very pleasant surroundings, and often include a few trees, some bushes, fruits, flowers and several other Nature's bounties! Their independent compounds, the porches, rooms for guards and the like besides providing convenience, add to the grace of the houses.

Such Bungalows are, none-the-less, prone to thefts and burglary and occupants really can not keep the houses locked or un-manned while going out of town. Such houses & occupants would also be exposed to the odds of excessive rainfall, floods, water-logging and further rats and reptiles also have access to such houses and of-course the mosquito bites! On the other hand, high storied flats in the sky scrapers provide a heavenly view & are also equipped with safety & security systems. These flats and buildings, together however, form concrete jungles far away from nature and are very short of being good houses in the absence of open space around them for trees, bushes & grass and of course. They are very much short of grace, grandeur and status of a bungalow.

It is therefore desirable that an ideal house needs to have qualities, facilities and grace of both a Bungalow on an independent plot and a high storied flat in a sky scraper.

OBJECTS OF THE INVENTION

It is an object of this invention to provide a solution for the scarcity of land.

It is another object of this invention to provide a method for construction of spaces, particularly residential spaces.

It is also an object of this invention to provide houses on artificially created plots.

Another object of this invention is to provide better living conditions in urban areas.

Yet another object of the invention is to multiply openness around houses in urban areas.

Still one more object of this invention is to make better use of the limited land available in urban areas.

Further, another object of this invention is to multiply the land area around houses, particularly to provide lush greenery around each of them.

Further, another object of this invention is to mitigate the ill effects of pollution in urban areas and reverse global warming.

Further, another object of this invention is to eliminate congestion caused by cramped dwellings and by overcrowding of houses/flats and buildings in urban areas.

Further, yet another object of this invention is to eliminate vehicular congestion, parking of vehicles on roads causing traffic snarls.

Further, yet another object of this invention is to combine together qualities of both a luxurious bungalow and a high storied flat, to enhance their qualities and to eliminate their respective shortcomings.

Further, yet another object of this invention is to provide land area for at least some of the houses for cultivating and producing vegetables and fruits for consumption by the occupant families.

Further, another object of this invention is to convert concrete jungles in urban areas into verdurous paradises of green.

Further, yet another object of this invention is to generate and provide electricity regularly and permanently for dwellings and services in the structure i.e. to make these structures and houses self dependent in respect of power, the electricity by fixing solar panels harnessing full sunlight and illumination and by installing wind mills making use of high altitude and plentiful breeze; and to reduce the burden on power grids.

Further, another object of this invention is to provide a solution for protecting houses, people and their properties from natural calamities such as excessive rainfall, floods, pestilence, water-logging, rising sea level due to global warming and even from the Tsunami!

Further, yet another object of this invention is to enable one and more particularly the civic authorities to plan a 'dream-cum-true' town or urban area or at least a locality with entire area all around open up to a height of around 10 meters or more up to around 50 meters for absolutely free movements of people, vehicles and for other public uses such as parks, gardens, for agriculture, cultivation, . . . the works! In such dream-towns there can be horizontal connecting road ways, access lanes at a height of around 30 to 50 meters, again at around 60 meters and so on, virtually creating several tiers for free movements within, making "Sky-villages" in towns and even in metropolises a reality.

Further, one more object of this invention is to do away with the congestion, promote greenery at the same time, making houses and localities self-sufficient in power, water resources, drainage system, vehicles parking and in addition, making the entire ground level available for public uses and in turn, addressing well the problems anticipated by the civic authorities and reduce the burden on them.

Further, yet another object of this invention is to protect & preserve Heritage buildings, to cover & protect small and large playgrounds, any public place and at the same time to use them for accommodating more and more dwelling and non-dwelling structures. without disturbing and in-fact with protecting their public utility. Protection from hot sunlight and wash-away rains will preserve heritage buildings for ages with substantial reductions in their maintenance costs. On playgrounds, there would be no rain interruptions in matches, games! Playgrounds will be "In-door" since covered and at the same time "Out-door" in view of complete openness and in fact would boast the best of both worlds.

An architectural structure in accordance with this invention can therefore be constructed on any public place without disturbing and in-fact with protecting their public utility.

Further, still another object of this invention is to set a new trend in the construction industry with the new concept, a different direction viz. creating artificial plots for houses, vegetation, parking and other uses and a concept of utilization of area as well as height i.e. the volume above a plot; in other words, to provide a way for Green Vertical expansion in the metropolises.

SUMMARY OF THE INVENTION

In accordance with this invention there is provided an architectural structure, said structure comprising, at least one core column structure;

a plurality of recessed platform structures successively extending operatively orthogonally from said column structure and supported thereby, said successive platform structures spaced apart vertically and horizontally from each other so that each of the platforms is adapted to receive adequate sunlight and ventilation independently and an unobstructed scenic view;

landfill filled in said recesses of the recessed platforms to form plots;

water reticulation systems provided in at least some of said platforms connected with each other and to a central water supply system; access means connecting the plots with the ground level and with other plots; and amenities/utilities provided to at least some of said plots.

Typically, no platforms are provided to the column structure at least up to a height of around 10 meters to around 30 meters.

Typically, each of the plots is provided with fencing around the edge of the platform.

Typically, the platforms is provided with a protective fencing and a security fencing at two levels extending from the outer side of the platform to prevent any object from falling down.

Typically, the size of the platforms reduces as the level increases.

Typically, the column structure includes support columns and beams and trusses.

Typically, the core column structure is hollow.

Typically, the core column structure is solid and includes support columns which are hollow.

Typically, the column structure encloses the access means.

Typically, the column structure provides conduits for the water supply system, amenities and utilities.

Typically, the recessed platforms are provided around the core column in from of a petal formation.

Typically, at least some of the recessed platforms are at the same level or plane.

Typically, all the recessed platforms are at different elevated levels.

Typically, the landfill includes an aggregate of stones, gravel, soil and clay.

Typically, the landfill material is graded into top soil, sub soil and earth containing stones, gravel, soil and clay.

Typically, the landfill includes segments of landfill made by compacting stones, gravel, soil and clay together off site and transported to site for filling the recesses.

Typically, the landfill includes sections of land dug out from the ground and placed in the recesses which eventually get diffused into one other and form an integrated landfill.

Typically, the water reticulation system includes independent water connection to each of the said plots.

Typically, the reticulation system includes treatment plants for treatment of water after use at each plot.

Typically, the water reticulation system includes means to supply water treated at one plot for use at a plot at a lower level.

Typically, the water reticulation system includes means to collect water percolated through at least some of the plots and supply the collected water to a plot at a lower level.

Typically, the water reticulation system includes a perforated plate provided spaced apart from the base of the recess in said platform, forming a space between said plate and the recess for collection of the water percolated through the landfill.

Typically, the water reticulation system includes a treatment plant for treating water collected at one plot to be supplied to another plot.

Typically, the water reticulation system includes holding tanks at least at some of the plots for holding treated water.

Typically, the water reticulation system includes pumping means to pump water collected at the lowermost plot upto the top of the structure for re use; optionally after a final treatment.

Typically, the water reticulation system includes means to monitor the quality of the water to be supplied and means to divert water for further treatment if not found satisfactory for use.

Typically, the water reticulation system includes a solid waste management which includes a compost pit located at ground level to receive solid waste from the treatment plants in the system.

Typically, the structure includes a security fencing provided around the plot adapted to collect rain water and supply the collected rain water to the water reticulation system.

Typically, the access means includes staircases, escalators, roadways, ramps and lifts.

Typically, at least one housing structure is constructed on some of the said plots; said housing structure selected from a group of housing structures consisting of a dwelling, a bungalow, a club, an educational structure, a shop, a parking lot, a recreational facility, a gym, a playing ground, a power plant, a wind mill, and a library.

Typically, the said central or support column forms part of the housing structure built around it.

Typically, the housing structures on different plots do not share a common floor or roof.

Typically, the plots are adapted for use for agricultural, horticultural, landscaped garden, park, vehicular parking, helicopter landing, recreational, and/or sporting.

Typically, the plots are adapted for use for agricultural, horticultural, landscaped garden, park, recreational, and sporting use and the water reticulation system includes a drip irrigation system passing through the landfill in the plots.

Typically, the plots are provided with means, such as awnings for protection from rain.

In accordance with this invention there is provided a method for creating an architectural structure, said method comprising the following steps;

constructing at least one column structure;

constructing plurality of recessed platform structures successively extending in an operative horizontal position from said column structure and supported thereby, said successive platform structures being spaced apart vertically and horizontally from each other so that each of the platform is adapted to receive adequate sunlight and ventilation independently and an unobstructed scenic view;

filling the recesses in said recessed platforms with a soil bed to form plots, wherein said soil is an aggregate of soil, clay, gravel and stones;

constructing housing structures on at least some of said plots;

providing a water reticulation system for at least some of said plots connecting water reticulation system in said plots to each other and to a central water supply system;

providing means to access said plots from the ground level and from other plots; and providing amenities/utilities to at least some of said plots.

Typically, the method includes constructing each of the elevated plots at different level in the form of petals.

Typically, the method includes providing support structures, such as beams, trusses and support columns for supporting the plots.

Typically, the method includes creating a gap at the base of each platform for collecting water percolated through the land fill in the platform and connecting the gap to the water reticulation system.

Typically, the soil bed is prepared in the recess by filling the recess with soil, clay, gravel and stones in a graded manner.

Typically, the method includes recycling water after treatment and separation of solid waste from plot to plot and using the recycled water from a plot at a higher level, at a plot at a relatively lower level.

Typically, the includes the step of constructing plots starting from a height of around 10 meters to around 30 meters for free movements of people, vehicles and for other public uses as vehicle parking, parks below the architectural structure.

Typically, the method includes constructing said housing structures or spaces on said plots such that, no two structures or spaces on different plots share a common roof or floor.

Typically, the method includes constructing said housing structures or on said plots by incorporating the columns within the housing structure.

Typically, the method includes constructing a dwelling space surrounded by a landscaped garden on said plot.

Typically, the method includes providing means to protect said housing structures from direct sunlight and unwanted heat and from rain and inclement weather.

Typically, the method includes providing solar panels mounted on the plots, and around the plots for generating electricity; generating electricity therefrom and using said electricity in the housing structures on said plots and for the water reticulation system.

Typically, the method includes generating electricity by means of a windmill on the any of the plots and preferably on the topmost plot.

Typically, the method includes providing means for harvesting of rain water and storing said rainwater in holding tanks for later use.

Typically, the method includes providing means for treatment of used water and recycling of the treated used water.

Typically, a series of such structures are connected by roadways, lanes at a height of 30 meters, and again at a height of 60 meters and so on, creating "Sky-villages".

BRIEF DESCRIPTION OF ACCOMPANYING DRAWINGS

Figure 2:
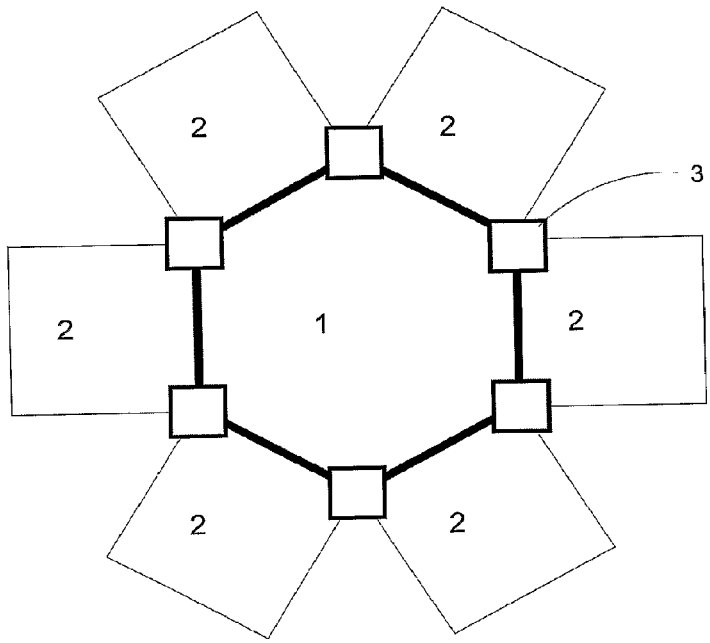
Figure 3:
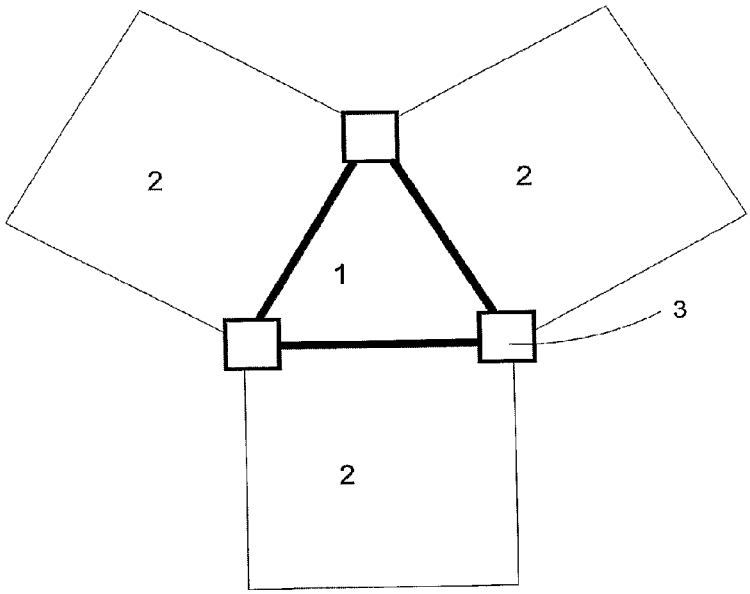
Figure 4:
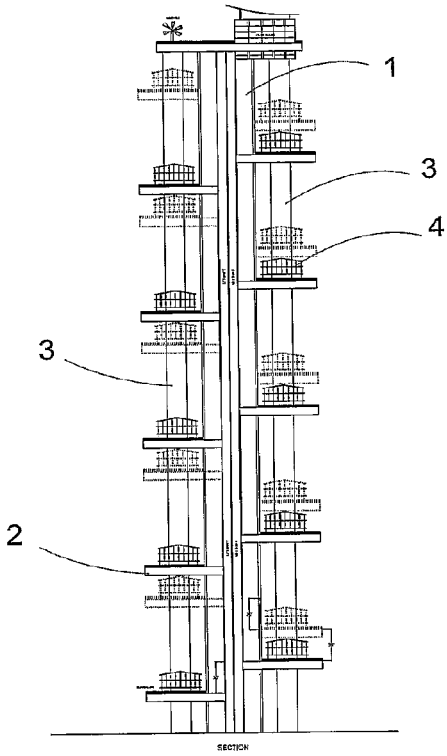
Figure 5:
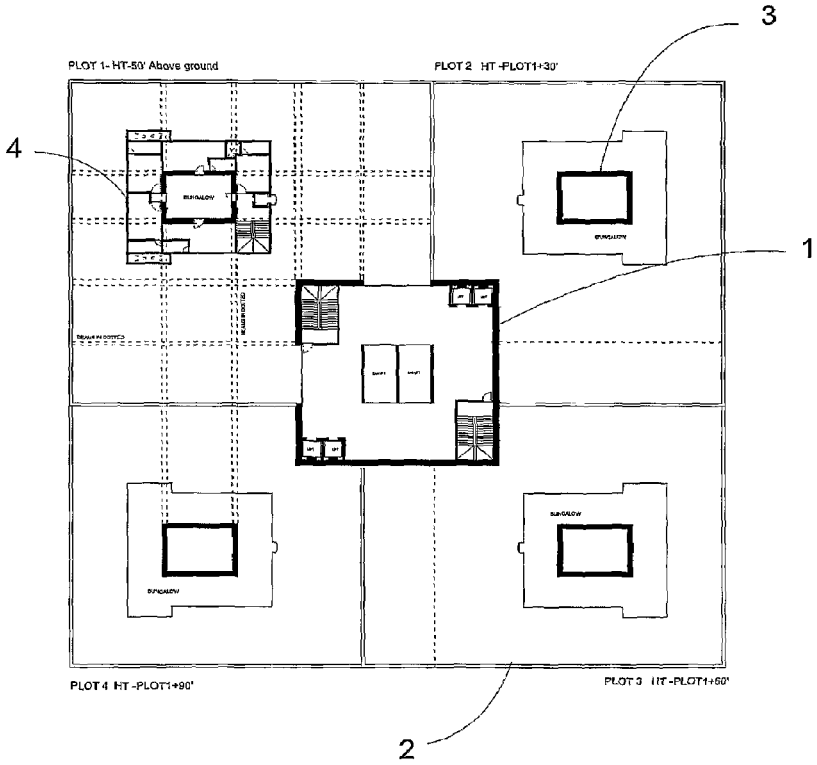
Figure 6:
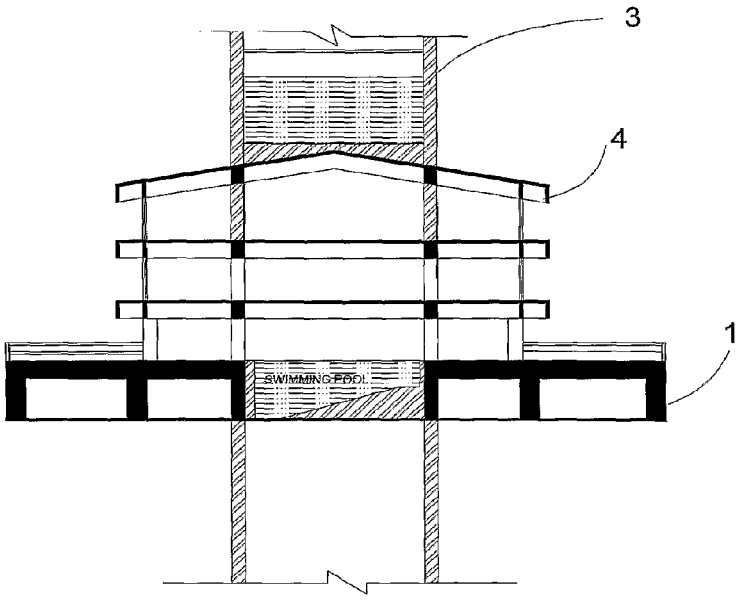
Figure 7:
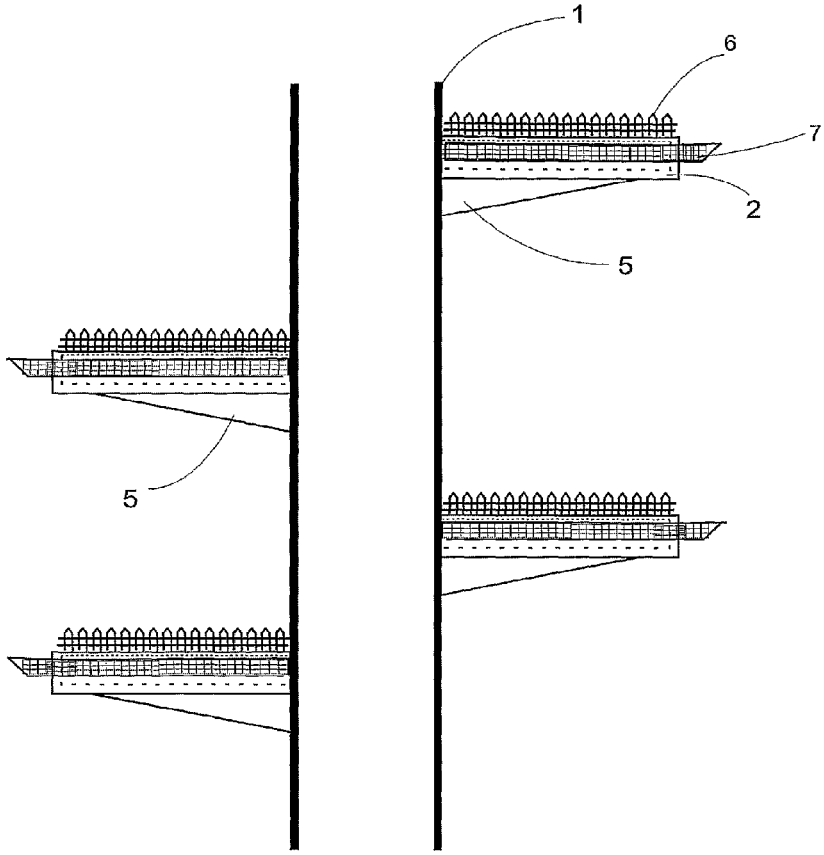
Figure 8:
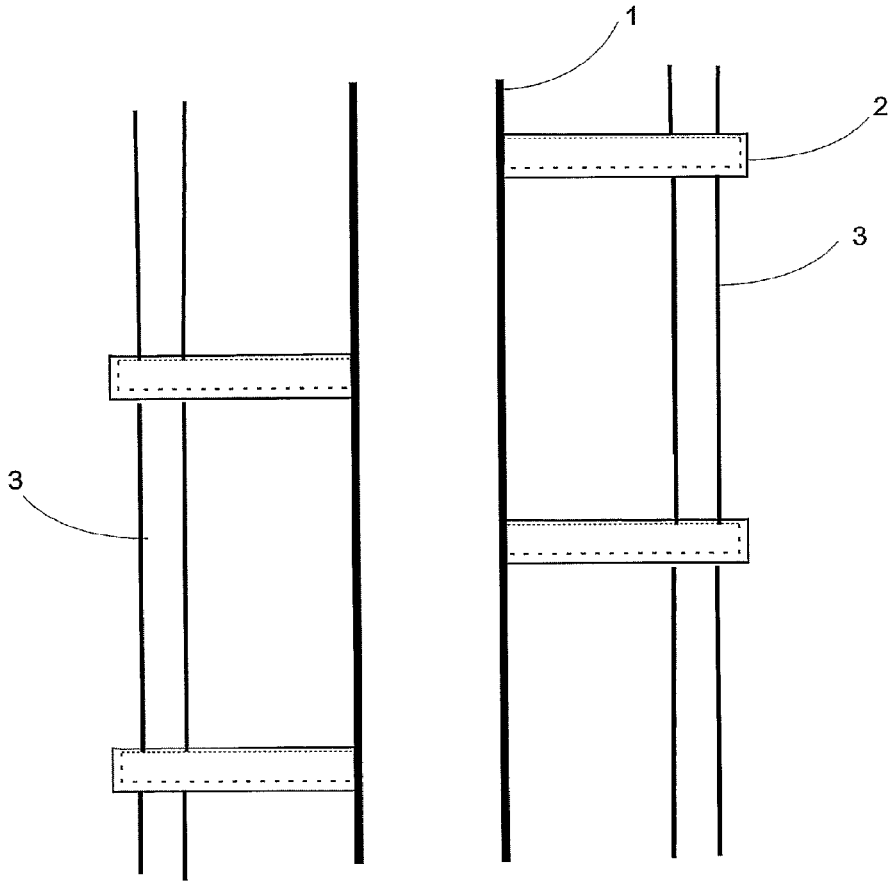
Figure 9:
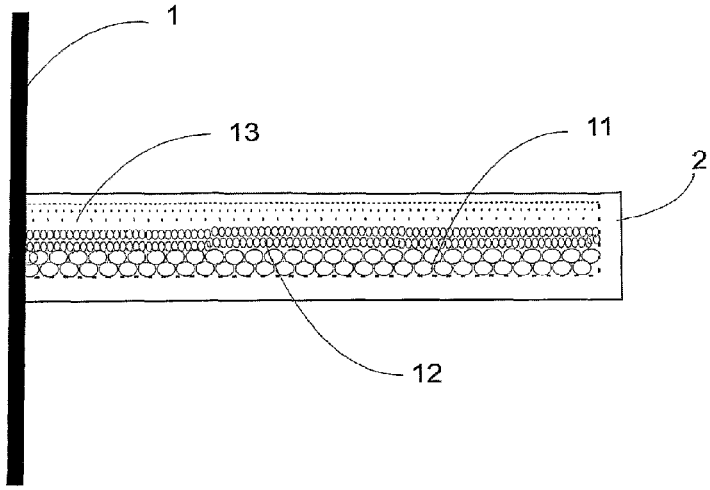
Figure 10:
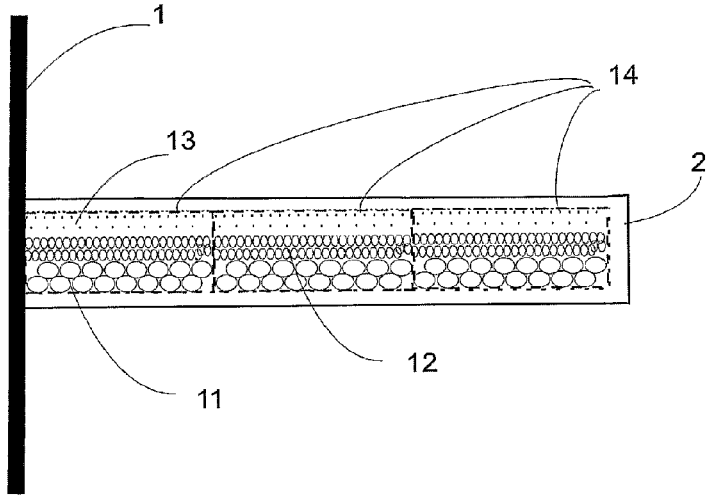
Figure 11:
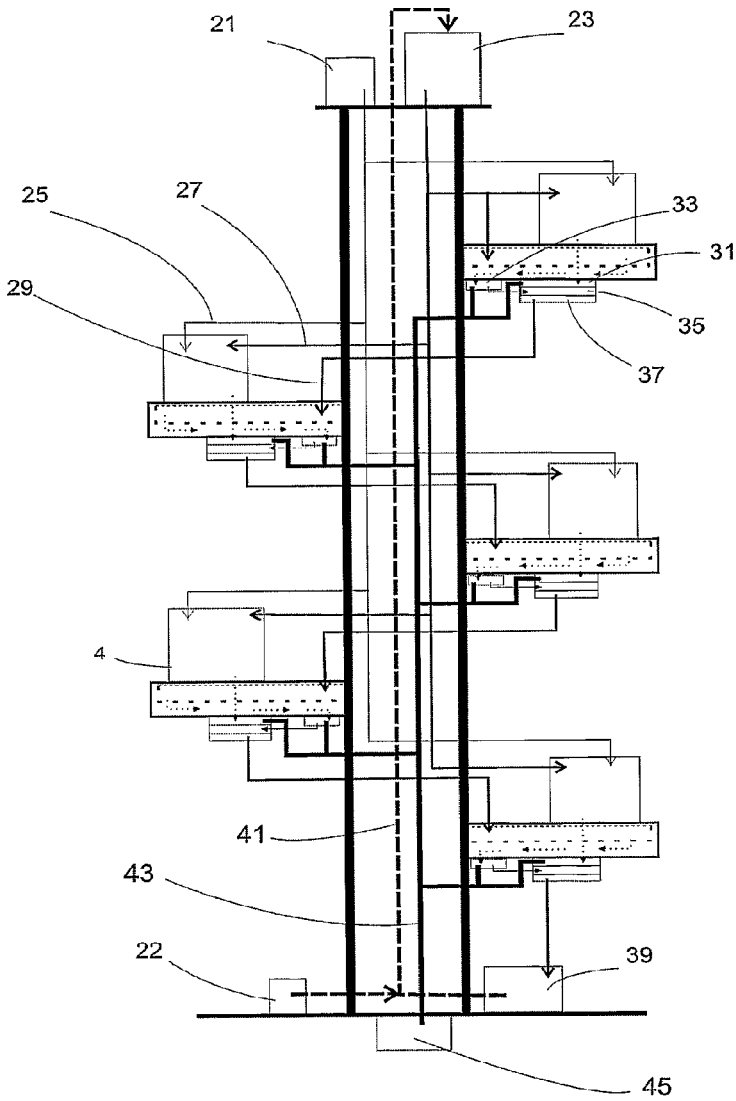
Figure 12:
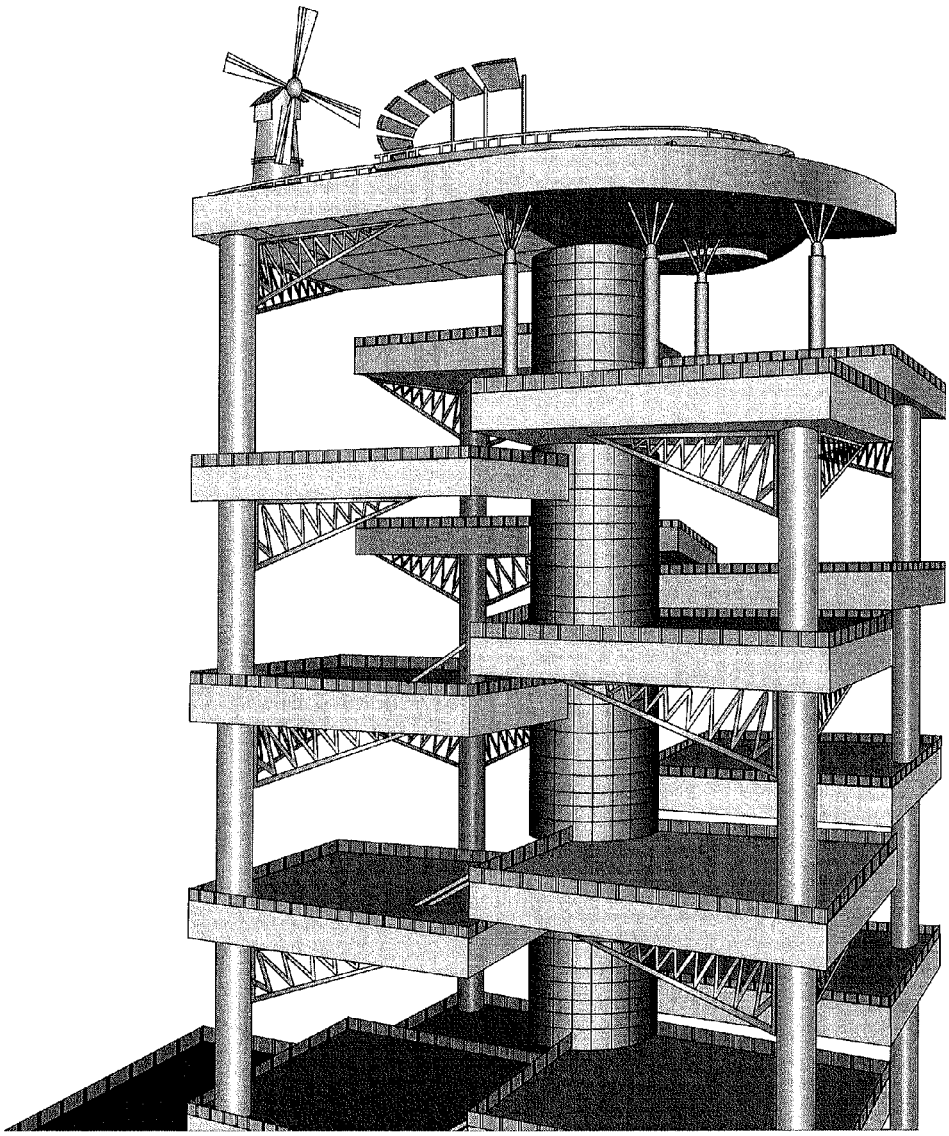
Figure 13:
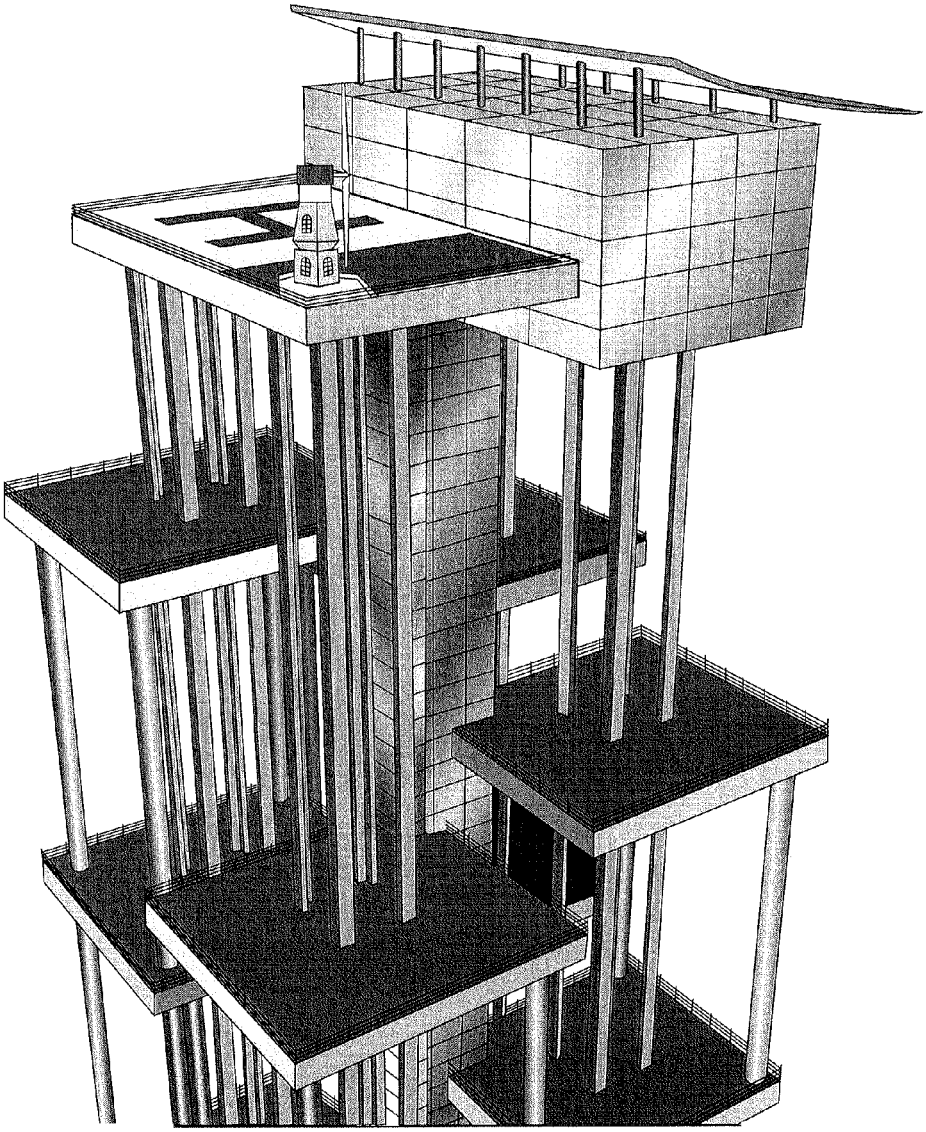
Figure 14:
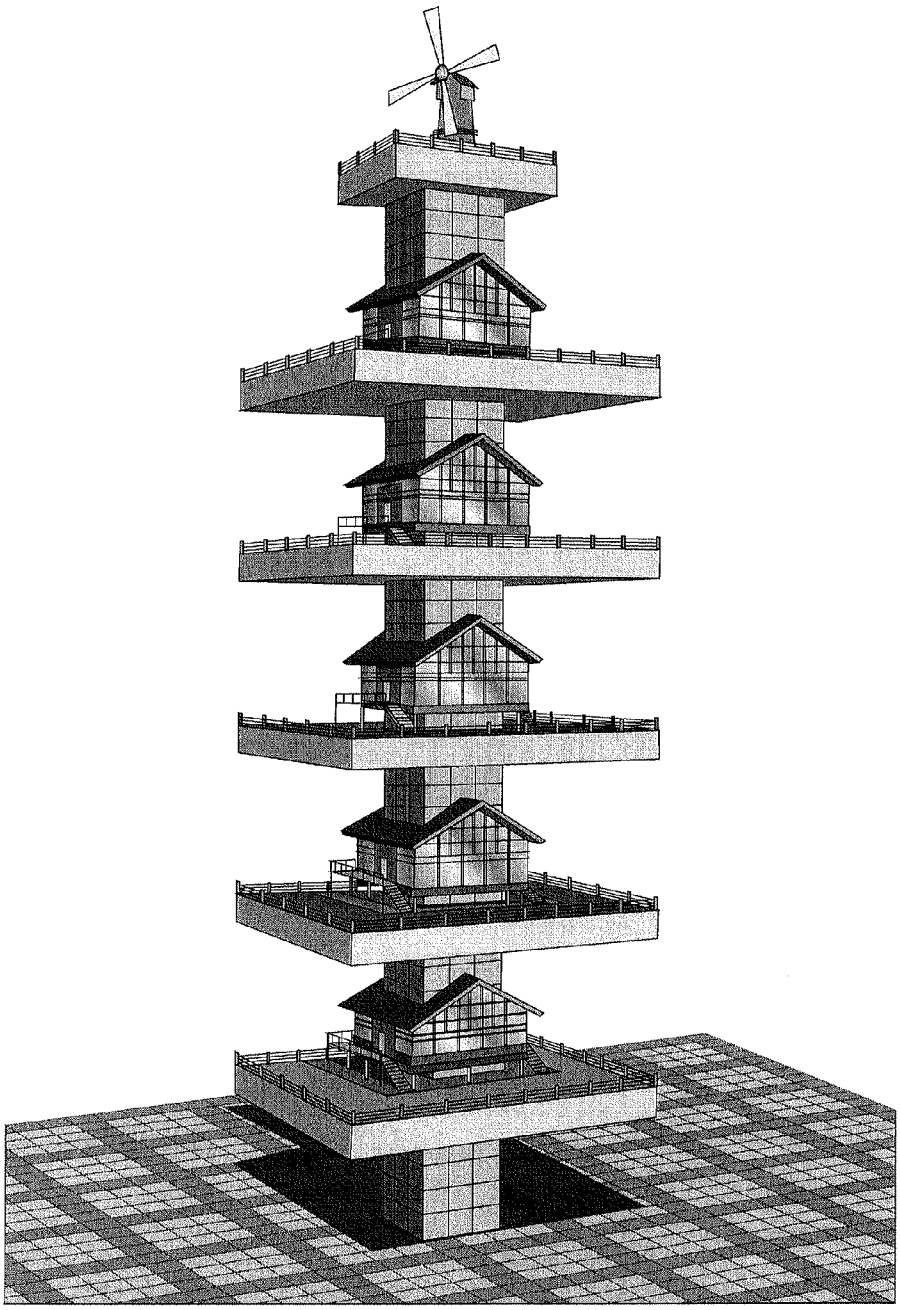

The invention will now be particularly described with reference to the accompanying drawings, in which FIG. 1 of the accompanying drawings illustrates a structure with plurality of recessed platforms, in accordance with this invention;

FIG. 2 of the accompanying drawings illustrates a horizontal sectional view of a structure in accordance with this invention, having 6 petals/wings;

FIG. 3 of the accompanying drawings illustrates a horizontal sectional view of a structure in accordance with this invention, having 3 petals/wings;

FIG. 4 of the accompanying drawings illustrates a vertical sectional view of a structure with plurality of plots with a housing structure constructed on each of said plot, in accordance with this invention, having 4 petals/wings;

FIG. 5 of the accompanying drawings illustrates a horizontal sectional view of a structure showing the elevated artificial plots constructed in a spiral manner around the core column structure and supported by columns, in accordance with this invention, having 4 petals/wings;

FIG. 6 of the accompanying drawings illustrates a sectional view of a recessed platform with a housing structure constructed on it;

FIG. 7 of the accompanying drawings illustrates a view of the structure in accordance with this invention, showing a plurality of recessed platforms supported by trusses and beams and provided with a security fencing and a protective wire mesh fencing;

FIG. 8 of the accompanying drawings illustrates a view of the structure in accordance with this invention, showing a plurality of recessed platforms supported by support columns;

FIG. 9 of the accompanying drawings illustrates a sectional view of a recessed platform showing the graded landfill in accordance with this invention;

FIG. 10 of the accompanying drawings illustrates a sectional view of a recessed platform showing plurality of landfill segments used to fill the recess in said platform, in accordance with this invention;

FIG. 11 of the accompanying drawings illustrates a view of the water reticulation system in accordance with this invention;

FIG. 12 of the accompanying drawings illustrates a view of elevated plots, in accordance with this invention, having 4 petals/wings with support means;

FIG. 13 of the accompanying drawings illustrates a view of elevated plots, in accordance with this invention, having 4 petals/wings and the support column structure;

FIG. 14 of the accompanying drawings illustrates a view of structures on elevated plots, in accordance with this invention, having a single petal/wing formation such as on a small plot of land.

Figure 15:
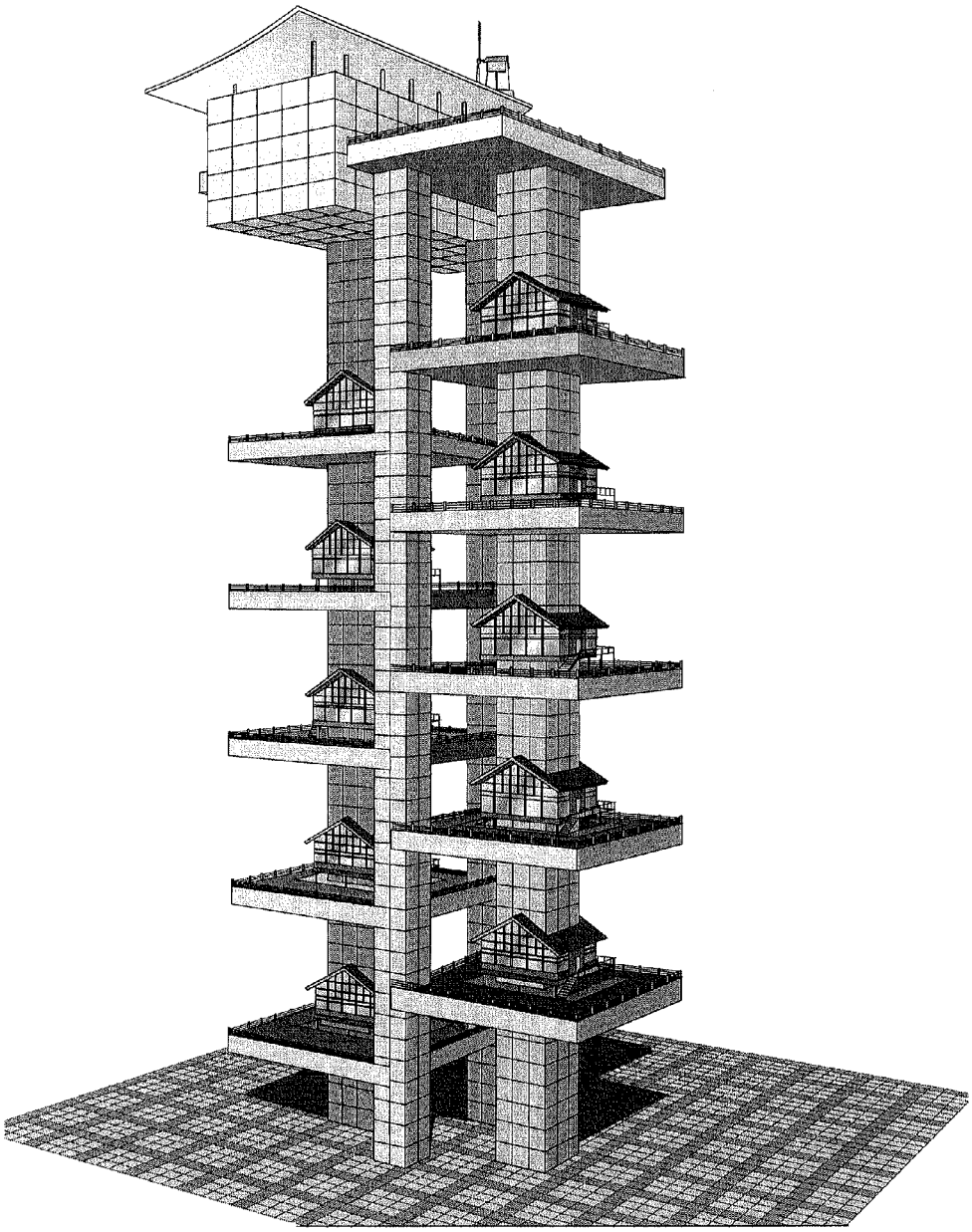

FIG. 15 of the accompanying drawings illustrates a view of structures on elevated plots in accordance with this invention, having two petals/wings formation such as on a rectangular shaped plot of land.

Figure 16:
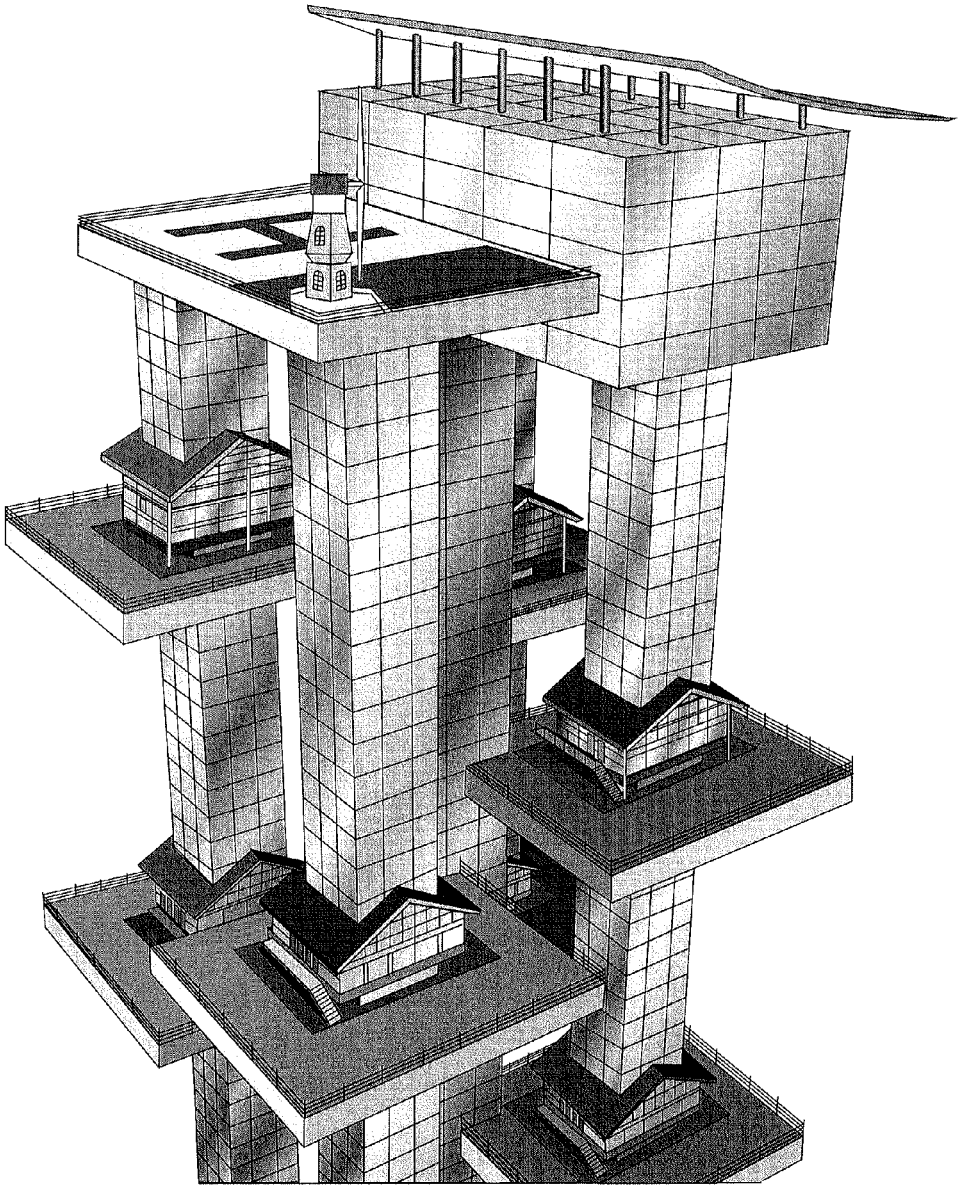

FIG. 16 of the accompanying drawings illustrates a view of structures on elevated plots in accordance with this invention, having 4 petals/wings formation such as on a larger plot of land.

Figure 17:
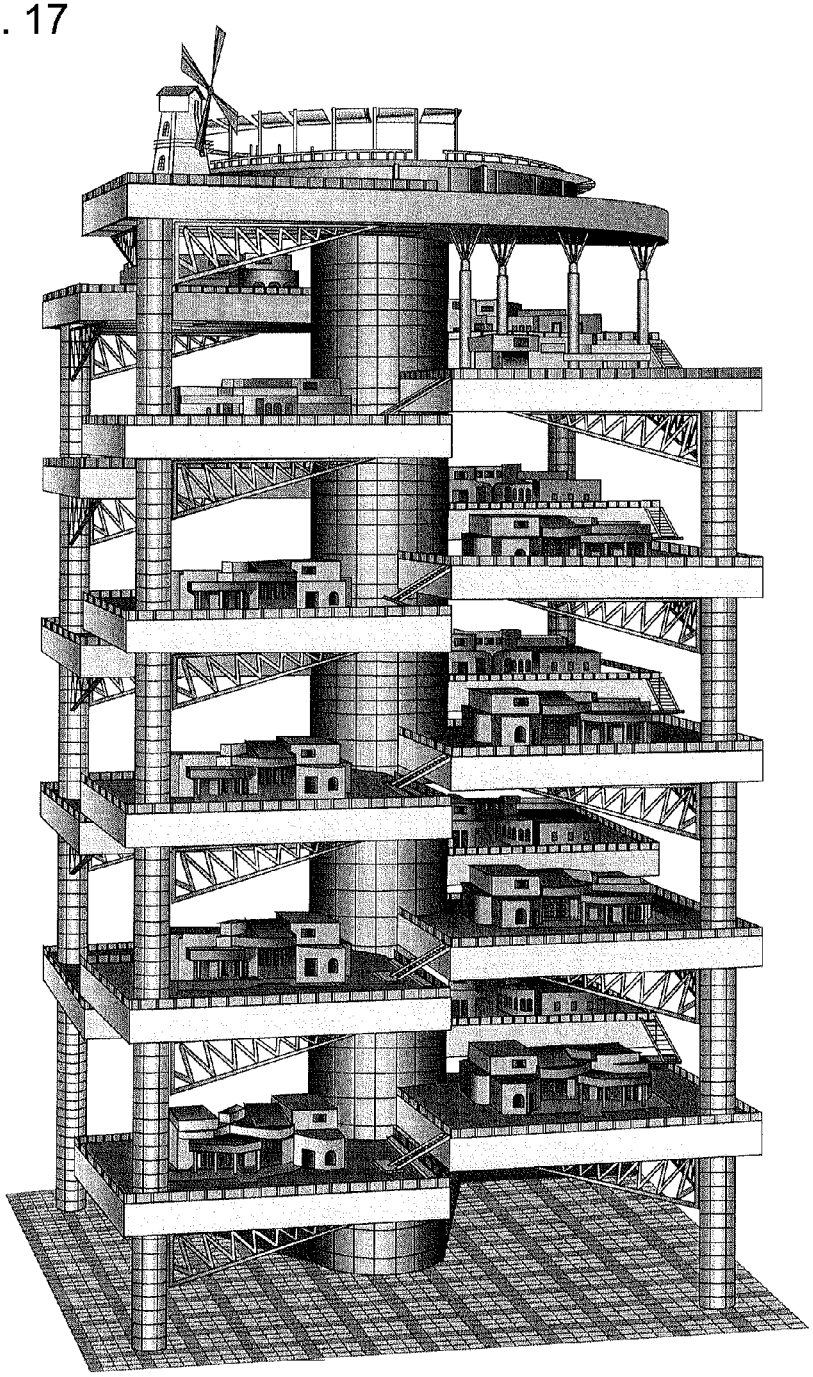
Figure 18:
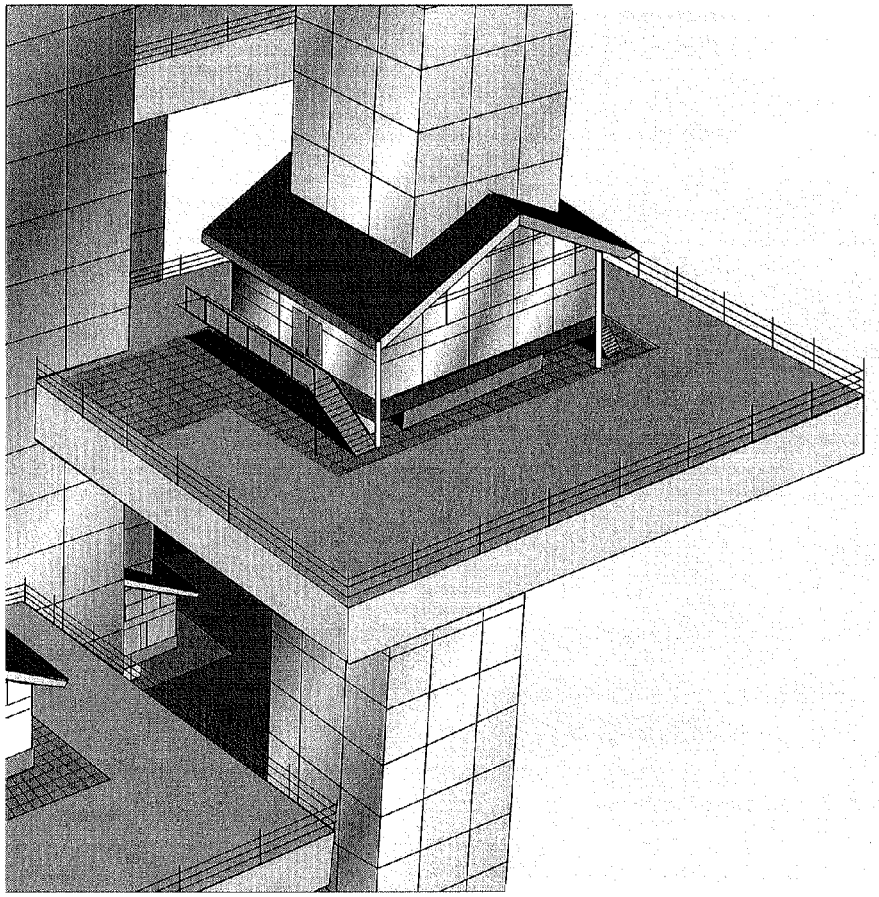

FIG. 17 of the accompanying drawings illustrates a view of a structure having 4 petals/wings with dwellings on each of said platform and supported by trusses in accordance with this invention; and FIG. 18 of the accompanying drawings illustrates a view of a single plot and a dwelling built around the support column structure in accordance with this invention.

DETAILED DESCRIPTION OF ACCOMPANYING DRAWINGS

FIG. 1 of the accompanying drawings illustrates a structure with a plurality of plots (2) extending from a column structure (1), in accordance with this invention. An architectural structure providing elevated plots (2) is envisaged in accordance with this invention. The architectural structure comprises at least one core column structure (1); a plurality of recessed platform structures (2) extending operatively orthogonally from said column structure (1) and supported by support columns (3). The platform structures (2) are spaced apart vertically from each other and are filled with landfill to form plots. Water reticulation systems are provided in at least some of said platforms (2) and are connected with each other and to a central water supply system. Access means connecting the plots with the ground level and with other plots are also provided. The access means includes staircase and lifts for persons, for goods and also lifts for vehicles. Ramps or roadways connecting the plots with ground and with other plots may also be provided from within the hollow column structures or from outside. The platforms are provided to the column structure (1) only above height of 10 meters or above 30 meters so that the area on the ground level is vacant for free movements of people, vehicles and or for use as public parks, vehicle parking and the like.

The recessed platforms (2) are provided around the core column (1) in a petal formation either single or more than one depending on shape and size of a plot of land. Some of the recessed platforms (2) are at the same level or co planar. In another embodiment the recessed platforms are at different elevated levels or in a different plane. FIG. 2, FIG. 3 and FIG. 5 illustrate the different embodiments of a structure in accordance with this invention, having 6, 3 and 4 petals/wings respectively. These plots which are constructed in form of petals which can be constructed in same plane, side by side or they may be constructed in different planes. FIG. 5 of the accompanying drawings illustrates a horizontal sectional view of a structure as shown in FIG. 4. The elevated plots are constructed in a spiral manner around the supporting column structure, in accordance with this invention.

The column structure includes support columns (3) and beams and trusses (5). The core column structure (1) is typically hollow. In another embodiment the core column structure (1) may be solid and the structure may include support columns (3) which are hollow. These hollow columns structures enclose the access means. The column structure also provides conduits for the water supply system, amenities and utilities. FIG. 7 of the accompanying drawings illustrates a view of the structure in accordance with this invention showing a plurality of recessed platforms supported by trusses and beams. Each of the plots is provided with a protective fencing (6) on the edge of the platforms. Each of the platforms is also provided with a second level of fencing (7) in form of a wire mesh fencing on the outer side of the platform to prevent any object from falling down. The size of the platforms reduces as the level increases. Typically, the size of the platforms reduces by the width of the two fencings combined.

FIG. 8 of the accompanying drawings illustrates a view of the structure in accordance with this invention showing a plurality of recessed platforms supported by support columns.

FIG. 4 of the accompanying drawings illustrates the structure with plurality of plots (2) with housing structures (4) constructed on each of said plots. Plurality of columns (3) are constructed to support the artificial plots (2), and elevated plots are constructed at different levels. The housing structures (4) constructed in accordance with this invention do not share the roof or the floor with a house above or below it. The housing structure (4) constructed on some of the plots can be a dwelling space surrounded by a landscaped garden area. The structure (4) can also be a non dwelling space such as a commercial establishment, playground, stadium, utility generator, water storage facility or a covered parking. The housing structure (4) may also be built surrounding the columns such that the column structure forms a part of the housing structure (4) built on the plot. In such an embodiment, the space between the columns is not hollow and is part of the space inside the structure. FIG. 6 of the accompanying drawings illustrates a sectional view of a recessed platform with a structure constructed on it. The plots are provided with a protective fencing (6) at the edge. A second level of fencing (7) is provided on the outer side of the platforms (2). The second level of fencing (7) is in form of a wire mesh or net and fitted in a manner as to catch any object falling from the platform. Means for hoisting and lowering the mesh fencing is provided to adjust the fencing and for cleaning purposes. In another embodiment the fencing (7) consists of series of flaps which at appropriate time can be folded or unfolded so that it can act as receptacle for rain water and can feed the collected rainwater to the water reticulation system.

The landfill includes an aggregate of stones (11), gravel (12), soil and clay (13). The landfill material is graded into top soil, sub soil and earth containing stones, gravel, soil and clay. In another embodiment of the invention the landfill includes segments (14) of landfill made by compacting stones (11), gravel (12), soil and clay (13) together off site and transported to site for filling the recesses. In yet another embodiment the landfill includes sections (14) of land dug out from the ground and, compacted for filling the recesses. These landfill blocks get diffused into one other and form an integrated landfill. A perforated plate is provided spaced apart from the base of the recess in said platform, forming a space between said plate and the recess for collection of the water percolated through the landfill. This space forms a part of water reticulation system. In one embodiment of the invention the water reticulation system also includes filtering means. FIG. 9 of the accompanying drawings illustrates a sectional view of a recessed platform showing the graded landfill in accordance with this invention. FIG. 10 of the accompanying drawings illustrates a sectional view of a recessed platform showing plurality of landfill segments used to fill the recess in said platform, in accordance with this invention.

FIG. 11 of the accompanying drawings illustrates the water reticulation system in accordance with this invention. As shown in the figure, the structure is provided with two tanks at the top, one tank for fresh water (21) and one tank for the recycled water (23). Each of the plot (2) is provided with an independent connection for fresh water (25). The fresh water is used for drinking, cooking and bathing. An inlet for recycled water (27) is also provided. Water from bore well (22) is used for cleaning, in toilets for flushing, gardening and the like and recycled to be used again. The drain water obtained from used fresh water and from cleaning and toilets is passed through a treatment unit one (31). From the treatment unit 1 (31), the water is collected in a holding tank (35). Recycled water is used for agricultural and horticultural purposes and for watering the gardens. The excess water seeps through the landfill and gets collected in the recessed platforms. This collected water is then passed to a treatment unit 2 (33). The water obtained after treatment from unit 2 is collected in the holding tank (35). The solid waste from treatment unit 1 (31) and treatment unit 2 (33) is collected and passed through a drain (43) to a composting pit (45). This solid waste contains only about 10% water and is converted into manure for agricultural, horticultural activity or for the gardens. The water collected in the holding tank (35) is then again passed to a treatment unit 3 (37). The water obtained after these three levels of treatment is fit for reuse. This treated water from a particular plot is used as recycled water for garden and agricultural purposes for the plot below it. In addition the graded landfill also acts as a natural filter bed. In this manner, the water is recycled at each level and used at the nest lower level till the water reaches the lowermost level. The water from the lowermost level is treated in the final treatment plant (39) at the bottom of the structure and then pumped up to the tank (23) at the top of the structure through a pipeline (41) in order to be reused. The recycled water passes from one level to other by means of gravity and does not require pumping. The water reticulation system is provided with a monitoring system to monitor the quality of recycled water. The monitoring system is provided at each level and monitors the quality online. The monitoring system checks the solid particulate content, organic matter content, toxic materials, and the like. In case if the monitoring system finds the treated water not fit for reuse even for agricultural purposes, then the water is sent to the treatment unit of the lower level through a by pass valve. The treated water is only reused after it meets the purity standards for reuse.

FIG. 12 and FIG. 13 illustrate the structure of this invention with support means. FIG. 12 illustrates the elevated plots supported by support columns and trusses and beams. FIG. 13 illustrates elevated plots with plurality of columns structures supporting it. These columns structures are typically provided at predetermined points such that a dwelling unit can be built surrounding these columns.

FIGS. 14 to 18 illustrate the different embodiments of the structure with respect to number of petals and dwellings constructed on the plots created. FIG. 14 of the accompanying drawings illustrates a view of a structure having a single core column and platforms one above the other in accordance with this invention. FIG. 15 of the accompanying drawing illustrates a view of a structure having two petals. FIG. 16 of accompanying drawings illustrates a view of the structure having four petals and dwellings built on each of the petal in accordance with this invention. FIG. 17 of accompanying drawings illustrates a view of a structure having four petals with dwellings on each of said platform and supported by trusses. FIG. 18 of accompanying drawings illustrates a view of a single plot and a dwelling built around the support column structure.

In another embodiment the landfill is suitable for agricultural or horticultural use. A portion of the water reticulation system within the platform passes through the landfill. This part of the water reticulation system is provided with means for drip irrigation. The structure is provided with means for harvesting rain water and storing it for later use. The structure is also provided with means for treatment of sewage water.

The plots particularly the residential areas have shield for protection from direct sunlight and unwanted heat during afternoon hot hours and also from cloud bursting vertical rain.

In one embodiment of the invention, the structure is equipped with solar panels for generation of electricity. The solar panels absorb light energy of sunlight and generate electricity and also absorb the heat thus maintaining the temperature inside the structure. A wind mill is provided on the topmost plot or the roof and/or on some of the said elevated plots at high altitude to generate electricity.

Further, in accordance with another embodiment of this invention a dream-cum-true town or urban area or at least a locality with entire area all around open up till height of around 50 feet for absolutely free movements of people, vehicles and for other public uses such as parks, gardens, for agriculture, cultivation is built. There are horizontal connecting road ways, access lanes at a height of 50 feet, again at 100 feet and so on, virtually creating several tiers for free movements from one structure to another, creating a "Sky-village" in towns even in metropolises.

A method for construction of multi tier residential spaces in urban areas is envisaged by this invention. At least one hollow central support structure, is adapted to support said multiple tiers of the structure. A plurality of slabs are constructed one on top of the other, at predetermined minimum vertical distance from each other. This distance between the two slabs positioned exactly one on top of other is typically 50 feet. These slabs may also be built in a spiral manner around the central support structure reducing the vertical distance between successive levels. Thus, more than two slabs can be accommodated in 50 feet of the central support structure. At least one house is built on each of said slabs. These houses are built on these slabs around the central support structure. A landscaped garden is prepared on the area around the house on the slab.

In accordance with on embodiment of the invention, the central support structure is constructed to be hollow and is adapted to house the elevators and staircase. The column structure may also have a roadway or path for vehicles in order to drive the vehicle till the house at any level. The columns may be a part of the rooms of the houses that are constructed on the plots.

Each of said houses would have shield for protection from direct sunlight and unwanted heat during afternoon hot hours. Wind mills are installed on the topmost level or the roof and/or on some of the said elevated artificial plots at high altitude which generate electricity. A system for harvesting rain water and storing it in reservoirs for later use is also provided in the structure. There is a sewage water treatment system installed and the water after treatment can be used for watering plants in the gardens. Solar panels may be mounted on the column structure and other available places to generate electricity. The solar panels also absorb heat and help maintain the temperature inside the structures.

In accordance with another embodiment of this invention the structure is built in a water body or partly on land and partly on water body. In such a structure the sewage water which is treated is let into the same water body.

In accordance with another embodiment of this invention the structure is built off-shore. In such a structure, ocean waves and/or tidal energy could be used for generating power.

Further the invention envisages an artistic concept which multiplies openness by way of maximum open area and land around houses and therefore provides houses with

- Heavenly view better than that from a high storied flat in a sky scraper; and
- Maximum openness and sunlight that can also be harnessed by use of solar panels as also high altitude & good breeze providing option of windmills; thus, generating electricity, permanently.

The houses being open from all the sides provide natural ventilation and sufficient natural light. Thus, the structure is built in a way to prevent excess use of electricity for forced ventilation or lighting.

The architectural concept in accordance with this invention seeks to set a new trend in the construction industry viz. utilization of height in addition to area of a plot i.e. volume above the plot of land.

In accordance with one embodiment of this invention the available FSI for a given plot is to be divided as usual into number of bungalows to be constructed thereon. If the plot area is N and number of bungalows to be constructed are 20.

On even distribution, 'Built-Up Area' on the basis of available FSI for each bungalow unit will calculate to over N/20. Varying unit-sizes (large or small) is also workable.

In accordance with a practical embodiment of this invention a minimum number of columns of required strength, sizes & height and foundation capable of taking the load of the desired construction, are laid at the determined points on the plot of land. At a height of say around 50 feet, a slab of maximum possible/permissible area is laid on these columns with help of beams of required strength and sizes. Treating the slab area as a plot for one bungalow compound, gates are erected and trees, lawns are planted on soil beds on the platform slab, to suit requirement of individual prospective buyers. One bungalow unit say B-1, of over around N/20 sq.ft. Built-up-area is built on this slab (considering the slab area as an individual plot), amongst specified models, designs.

The columns are extended vertically and at a height of around 100 feet, another similar slab is laid providing similar compound, gates etc. with like trees and lawns—another bungalow unit say B-2, is built considering such second slab as another independent plot for the second bungalow unit.

Likewise, bungalow units say B-3, B-4, . . . B-20 are built on like slabs laid at 150 ft., 200 ft . . . , 1000 ft.

At any point of height (horizontal level) there will be only one house with almost entire plot area (to be precise N−N/20) open (vacant) around it.

Collectively desired number of bungalow units are built to suit individual's requirements and choices, amongst specified models and designs, each on independent slabs provided with compounds, swimming pools, gates, trees, lawns and everything else as desired and meant for a luxurious bungalow.

With arrangement of construction into 2, 3, 4 or even more petals/wings, the vertical gap between two consecutive bungalow units, say B-1 and B-2 can be reduced to just 25 feet, 17.33 feet or 12.5 feet since resultant gap between bungalows one above another i.e. B-1 and B-5 and so on, will remain to be around 50 feet. With such an arrangement, Bungalow units viz. B-1, B-2, . . . , B-20 are built on similar slabs on alternative petals/wings 2, 3 or 4 or even more, as the case may be, at a height of 50', 75', 90' . . . , 640' or at a height of 50', 67.33', 84.67', . . . , 350' or height of 50', 62.5', 75', . . . , 250', respectively.

Sufficient number of elevators, say 2 for vehicles—2 for goods and 2 for persons will be provided. Additional road/way for vehicles as also Helipad at prospective buyer's option can also be provided. Vehicles can go straight into compounds, porches of each of the bungalows right up to the topmost bungalow.

Typically, each house will be an independent luxurious Bungalow at a towering Height of 50 ft, 100 ft., 150 ft., . . . , 1200 ft. (Single petal/wing)

50 ft, 75 ft, 100 ft, . . . , 500 ft. (Two petals/wings)

50 ft, 67.33 ft, 84.67 ft, . . . , 350 ft. (Three petals/wings)

50 ft, 62.5 ft, 75 ft, . . . , 250 ft. (Four petals/wings).

In accordance with this invention each house will all the pleasures and facilities of a bungalow together with heavenly view as from a high storied flat in a sky scraper will be available to each house.

Particularly, each house will have full illumination, sunlight, maximum openness, space for greenery—lawns, flower gardens, kitchen gardens, swimming pool etc. associated only with bungalows along with safety & security of a flat system to boot!

Preferably at any point of height there will be only one house with almost entire plot area (precisely N−N/20) open around it.

Further, each house at the same time will have shield fro protection from afternoon (12.00 hrs. to 15.00 hrs.) direct sunlight and unwanted heat. It is envisaged that the top most level or roof level may be used as a sports or a water storage facility for the conglomerate of houses.

The total open area available will in fact be multiplied up to 2000%.

Further, the openness will provide space for solar panels and high altitude & breeze will facilitate windmill installation generating free electricity permanently!

The conglomerate of houses will have Elevators also for vehicles, road-way right up to the topmost Bungalow, and a Helipad at group option will cater to the wildest imaginations of a connoisseur of beauty and luxury!

Govt. owned plots of land with single bungalows for ministers and/or senior public servants, without much compromising with the luxury and beauty of the existent structures, can be utilized to accommodate more number of such bungalows with similar facilities. Open public places, play-grounds and even heritage/historical constructions after leaving required vertical gap can also be better maintained and can be protected from afternoon (11.00 hrs. to 15.00 hrs.) direct sunlight and unwanted afternoon heat and the rains that erode these precious structures, besides additional use for more accommodation at a height. Every plot of land, particularly at prime locations in metropolitan cities will be better utilized, in this manner.

It is further envisaged that the concept of this invention has potential to set a new trend in the construction Industry viz. to utilize volume i.e. height as well as area of a plot so as to provide ideal houses to more and more people. Hygienic and more open houses can also be provided for slum evacuees in SRD scheme who would otherwise languish in small cramped dark dwellings. This facilitates slum eradication and beautification of the cities.

The concept depicted in the figures is an integral concept in which an entire complex is envisaged. The column structures not only serve as basic supports of the dwellings in the form of bungalows but also conduits for services and transport. Thus at least one of the column structure may be hollow for the fitting of elevators for people, vehicles goods and services. Typically elevators and escalators and stair cases may be installed within the columns structure. Each of the levels may in addition or alternatively be linked by stairs or spiral motorable roads along the edge of the plots.

The water supply system may also be specially designed for the concept in accordance with this invention. For example, drip irrigation system may be provided for the garden and landscape features which may be reticulated commonly for the dwellings at different levels. Typically, the spill from one level may be used for watering at a lower level and the excess collected at the lowermost level may be pumped up again for iterating the watering process. The sewerage system and the watering system may also be integrated so that the kitchen and toilet and bath waste water may be reused for gardening and toilet purposes. The solid waste may be treated and used for development and nourishment of the garden and landscape areas within the concept itself.

Typically, the top level of the architectural concept in accordance with this invention may be used for energy capturing and creation and water storage for all the dwellings. Thus an array of solar panels and wind mills may be provided on the top level and other levels and the sides of the structures for receiving solar and wind energy and for converting this energy to electricity which in turn can be used for running the services for the structure; reducing the burden on power grids.

Each level may be planned with land fill and soil laid and planned similar to terrace gardens with proper drainage of the gardens. The solid waste created by the inhabitants of the dwellings may be collected, decomposed treated and used for the landfill itself for the gardens and landscaping.

Group safety and security of a flat combined with all pleasures & facilities of an independent bungalow including—enclosed compound, gates, porch, trees, lawns, badminton court, swimming pool . . . the works!

Typical calculation of built-up area and houses on a plot of land, say admeasuring 10,000 sq. meters comparing A) Present day traditional bungalows; &

B) Houses as per the new idea:

1. Say area of the plot is 10,000 (ten thousand) sq. meters and F.S.I. applicable to the area locality is say 1 (one).

Present day traditional bungalows to be constructed on the given plot, say 20 bungalows;

Each bungalow unit will have open sub-plot of around 350 sq. meters. area, after leaving around 30% area required for internal roads, access lanes, some space for recreational purposes.

Built-Up-Area available for each bungalow will be 350 sq. meters. with 10% more for balconies in addition to area for construction of staircase & lifts, another around 15%, collectively around 440 sq. meters.

After leaving minimum open area of over 3 meters on each of the four sides, the maximum area available for construction would be around 160 sq. meters.

One storied bungalow of B.U.A. 440 sq. meters. or two storied bungalow with each floor of 220 sq. meters. is not possible on a sub-plot of 350 sq. meters. as area available for construction is 160 sq. meters only.

Three storied bungalow is possible with each floor of 147 sq. meters. area and there will be 203 sq. meters. of open area around such bungalow in shape of strips of only around 3 to 4 meters width on all the four sides.

Four storied bungalow will have each floor of 110 sq. meters and will have open area of 240 sq. meters i.e. 4 meters. wide strips open on two sides and 4.5 meters wide strips on remaining two sides.

Keeping stilt and constructing the floors above would make ground floor space available for parking of vehicles, servants toilets etc. Alternatively, leaving lesser open space on one or two sides make some more open space available on remaining two sides. This is what is being done presently.

In any case, space available for gardens, greenery is always marginal, in the shape of narrow strips of few meters in the width causing limitations for one's desire to go for trees, plants and lawns. Trees planted by one member often encroaches on open space of neighboring units raising uncalled for disputes & quarrels.

Any more number of houses say 40 or even around 100 are possible on the given plot but at the cost of compromising with open area around for greenery etc. and, thus, the pleasures and luxuries. With anything more than 20-30 houses on the given plot, they will not have the grace & grandeur of luxurious bungalow although they would still be pleasant dwellings.

In case of 100 houses on the given plot, each house would have 70 sq. meters of B.U.A. with likewise 10% for balconies and another around 15% or little more for staircase and lift i.e. collectively 87 sq. meters evenly divided in 2 or 3 floors. They can not be equated to an independent bungalow but can be a row-house i.e. houses in row having one or more common walls in between them. Such houses will have two sides, front and back, open with some place for few trees, small lawn or tiny back-yard! Everything will be a miniature an apology for a bungalow! The plot of 10,000 sq. meters will be somewhat crowded with these 100 houses thereon. Openness would be marginalized and result would be obvious!

Number of houses may have to be restricted to 20 or 30 so as be good independent bungalows. These houses of course, are prone to thefts, burglaries and occupants really can not keep their house locked or un-manned while going out of town. These houses and occupants would also be exposed to odds out of excessive rainfall, floods, water logging. Rats and reptiles also have access to such houses and of course mosquito-bites.

These houses would still provide privacy, several pleasures & luxury like some (if not many, at least few) plants, some creepers, some fruits, some vegetables, lawn, morning tea and or evening treats on one's private lawn and many other advantages besides the grace and stateliness of an independent bungalow.

B. Construction of houses as per the envisaged scheme! Say same number i.e. 20 houses are built on the given plot.

(i) Minimum required number of columns of required strength, sizes & height capable of taking the load of the desired construction, to be laid at the determined points on the plot of land.

(ii) At a sufficient height of around 50 feet, a slab of maximum permissible area upto around 3600 sq. meters is to be laid on these columns with help of beams of required strength and sizes. Treating the slab area as plot for one bungalow a compound, gates would be erected and trees, lawns are planted on soil beds on the slab with swimming pool, badminton court etc. as per choice of individual prospective buyer. One bungalow unit say B-1 of 625 sq. meters area is built on this slab (considering the slab area as an individual plot), as per choice of such buyer amongst specified models, designs.

(iii) The columns are extended vertically and at a height of around 100 feet, another similar slab is laid providing similar compound, gates etc. with like trees and lawns—another bungalow unit say B-2, is built considering such second slab as another independent plot for the second bungalow unit.

(iv) Likewise, bungalow units say B-3, B-4, . . . B-5 are built on like slabs laid at 150 ft., 200 ft., 250 ft. At any point of height (horizontal level) there will be only one house with almost entire plot area (to be precise 10000-200) around it.

(v) Collectively, desired number of bungalow units are built as per individual's requirements and choices, amongst specified models and designs, each on independent slabs, the artificially created plots provided with compounds, swimming pools, gates, trees, lawns and everything else as desired and meant for a luxurious bungalow.

(vi) Four such petals/wings each accommodating 5 houses, one above another, can be constructed alongside one another and all four wings would collectively accommodate 20 houses each of 625 sq. meters.

(vii) While first artificial plot i.e. slab of wing A will be at a height of 50 ft, that of wing B will be at a height of 62.5 ft, wing C at 75 ft and wing D at 87.5 ft. so that all houses would get arranged spirally. Sufficient vertical gap between the adjacent consecutive bungalows and the vertical gap of 50 feet between any two bungalows one above another will provide all the openness, full sunlight, all the illumination to each of the houses. The minimum gap of 12.5 feet would mean that at any point of height there would be only one house in the entire plot area and that thus, each house besides land admeasuring 3600 sq. meters will have nearly 10,000 sq. meters of space open around it.

(viii) Each house will be on the artificially created independent plot i.e. the slab of the maximum permissible area up to around 3600 sq. meters. There would be everything on this artificial plot such as large sized lawns, gardens with different trees, bushes, kitchen gardens with several varieties of vegetables, swimming pool, badminton court, ample parking area, compound, gates . . . the works!

(ix) In the center of the four wings, there would be group of columns forming a conduit for staircases, elevators for persons, for goods and elevators also for vehicles. A road way can also be provided for vehicles. The vehicles can go right up to the topmost bungalow using the elevators or the road way.

(x) All houses being at the height above 50 ft. right up to 300 feet, will have a far more heavenly view than that from a high storied flat in a sky scraper.

(xi) Single petal construction i.e. all 20 houses one above another with a sufficient vertical gap say of 50 ft. is also possible. While first house will be at a height of 50 ft. the topmost house will be at height of 1000 ft. In such a case each house can have plot area (artificially created) of nearly around 8,000 sq. meters after leaving around 20% vacant area around.

(xii) Two petal construction is also feasible where first house will be at a height of 50 ft. while topmost at a height of 525 ft with each house having plot area of around 4,000 sq. meters of course after leaving 20% vacant area around.

(xiii) Different number of petals/wings are possible and the vertical gap can also be varied so as to manage construction cost within means of the prospective occupants.

(xiv) Each house built as per the envisaged idea will be "Two-in-One" i.e. The mix of a Bungalow and a High storied dwelling in a skyscraper, together. Simply put, Enjoying the best qualities of a bungalow as well as a skyscraper-flat at the same time, minus their respective shortcomings.

20 bungalows each of 625 sq. meters and for that matter any permutations and combinations are workable in this scheme! Very interestingly, with additional F.S.I. of 4 (four) being granted in constructions for rehabilitation of slums or redevelopment program, 2000 houses each of 25 sq. meters or 1250 houses each of 40 sq. meters can be constructed this way on the given plot. Dividing them into some houses for sale (so as to take care of entire construction cost including adequate arrangements for future maintenance etc.) and more number of houses for the poor slum dwellers is perfectly feasible. Needless to say, this would result not only in slum eradication but also in beautification of that locality and in creating heavenly homes for the poor! Considering the total elimination of congestion, the F.S.I. or the Development Control Regulations would be rendered redundant for construction made in this manner. Civic authorities may be satisfied about the major step in the envisaged way of construction towards striking the ecological balance and helping prevent global warming. If that be so, authorities may waive the restrictions being in-applicable and any amount of construction is very much possible—vertical expansion in the true sense—making towns fully green and more beautiful!

| Description | Present day traditional bungalows | Castles in the Air | Remark |
|---|---|---|---|
| 1. Given plot area | 10,000 sq. meters | 10,000 sq. meters | |
| 2. No. of Houses | 20 | 20 | |
| 3. Area to be left for internal roads, lanes etc | 2,500 sq. meters | 00 | 1:0 |
| 4. Area available for common use | 500 sq. meters | 10,000 sq. meters | 1:19 |
| 5. Plot area for each house | 350 sq. meters | 780 to 3600 sq. meters even upto 8000 sq. meters | 1:2 to 1:23 |
| 6. Constructed area for each house | 440 sq. meters | 625 sq. meters | 3:4 |
| 7. Total permissible construction including balconies, stairs, lifts etc. | 8,800 sq. meter | 12,500 sq. meter | 3:4 |
| 8. Constructed Area of each floor | 150 sq. meters | 210 sq. meters | 3:4 |
| 9. Open area for gardens, Lawns etc | 4,000 sq. meters i.e. 20 × 200 sq. meters. | 77,800 sq. meters i.e. 20 × 3390 sq. mtrs. + 10,000 sq. meters, (even upto 1,70,000 sq. meters) | 1:19 or 1:41 |
| 10. Parking space | sufficient | Several more vehicles can be parked | |
| 11. Openness for each house | 200 sq. meters | 9790 sq. meters | 1:49 |
| 12. Protection shield from afternoon heat | No | Yes; during hot hours | |
| 13. Height at which houses are situated | Ground level | 50 ft. to 300 ft. above ground level | 1:5 to 1:30 |
| 14. Place for solar panels | Available | Amply available | |
| 15. Wind mills installations | Not possible for want of sufficient height | Perfectly feasible the topmost point being at a height of 400 ft. | |
| 16. Place for recreation | Limited small area | Amply available | |
| 17. Feasibility of more number of houses | Increasing number of houses above 20 or 30 will make them cramped.. More F.S.I. would also not help to increase number of houses. | Number of houses can be increased easily, even over 100, remaining within permitted F.S.I.; with more F.S.I. any number of houses are possible with vertical expansion. | |

-continued

| Description | Present day traditional bungalows | Castles in the Air | Remark |
|---|---|---|---|
| 18. Cost of construction For civil work per sq. meter. | Rs. 5000/= | Rs. 25,000/= i. For slab (artificial plot) area 5 times the BUA of house = 10,000/- per sq. meter. BUA ii. For extended column height 5 times = 10,000/- p. sq. meter. | 1:5 |
| 19. Cost for all other finishing & interior work, per sq. meter | Rs. 5,000/= | Rs. 5,000/= | same |
| 20. Total construction cost, per sq. meter | Rs. 10,000/= | Rs. 30,000/= | 1:3 |
| 21. Value, per sq. meter | Rs. 10,000/= + 113.6% of Land cost + Builder's all other expenses & profits | Rs. 30,000/= + 80% of Land cost + Builder's all other expenses & profits | Ratio varies with variation in land cost. |
| 22. Value per sq. meter at locality where land cost is Rs. 60,000/= per sq. meter | Rs. 78,160/= + Builders all other expenses & profits | Rs. 78,000/= + Builders all other expenses & profits | Besides outstanding qualities, houses will be cheaper. |
| 23. Value per sq. meter where land cost is Rs. 2,00,000/= per sq. meter | Rs. 2,37,200/= + Builders all other expenses & profits | Rs. 1,90,000/= + Builder's all other expenses & profits | 20% cheaper. |
| 24. Benefits | Usual 20 bungalows of 440 sq. meters on individual plots of 350 sq. meters each. | i) Substantially Larger plots (open) for each house; ii) Larger houses of 625 sq. meters or 28 i.e. 8 more houses of 440 sq. meters area; iii) Houses at a greater height; iii) All the best of a bungalow as well as high storied flat minus their respective shortcomings; iv) Cheaper than traditionally built Bungalow. | Area consumed for internal road and lanes in ordinary course is saved in the envisaged way of construction. |
| 25. Sales prices | Usual under prevailing circumstances | Substantially more on account of 2 to 40 times greater plot(open) area for each house as well as outstanding characters of houses. | Each house may fetch more than double the price of a bungalow. |

Typical calculation of built-up area and houses on a plot of land, say admeasuring 10,000 sq. meters comparing A) Present day apartment buildings/flat system &

B) As per the new idea:

1. Say area of the plot is 10,000 (ten thousand) sq. meters and F.S.I. applicable to the area locality is say 1 (one).

A. Flats or Apartments to be Built on Such Plot, Say 100 Flats/Apartments:

Built-up-Area available for such a building will be 10,000 sq. meters with 10% more for balconies and in addition to common area required for staircase lifts & passages say another 15%, collectively 12,500 sq. meters.

100 flats/apartments of 125 sq. meters. each would be accommodated in the building.

A four storied building (without elevator) with each floor of 3125 sq. meters. accommodating 25 houses on each floor will have around 20 meters. of open area on two sides and 25 meters open on the remaining two sides.

An eight storied building but with elevator with each floor of 1500 sq. meters. with 12 houses on each floor, will have around 30 meters to 35 meters of open area on all the four sides.

A thirteen storied (one vacant floor) building with each floor of 1000 sq. meters. will be accommodating 8 houses on each floor.

A twenty-one storied (one vacant floor) building with each floor of 625 sq. meters. would be accommodating 5 houses on each floor.

A thirty-four storied (one vacant floor) building with each floor of 375 sq. meters will be accommodating only 3 houses on each floor.

A fifty-one storied (one vacant floor) building with each floor of 250 sq. meters will be accommodating only 2 houses on each floor.

There would be construction of around 12500 sq. meters of area divided evenly on number of floors and several options are available. There would be some open space and compound area utilized mostly for parking vehicles and for common use by all 100 families and to be used and maintained commonly by a co-operative housing society.

Each floor of such building will be accommodating 3 to 25 houses meaning thereby that each of the houses, in fact many of them, will not have both east west opening doors-windows. Houses only in buildings more than 25 storey tall (two, three or four houses being on each floor) will all have east-west openings while in all other options all houses can not have such doors-windows opening on east-west sides. This obviously means that most of such houses will be deprived of adequate sunlight, illumination and sufficient ventilation. Needless to say, all these houses can not have the pleasures & facilities of a bungalow let aside the grace & stateliness! In a flat system, everything outside your flat is common, passages, staircase, lawn, if any, and everything. So the feeling of ownership and privacy is limited only within the flat.

Thought process of members of 100 families can hardly go parallel and the bitter experiences take all to the obvious conclusion that "co-operation is hardly seen or extended and the word "Co-operative Society" exists only for namesake.

B. Construction of houses as per the envisaged scheme! Say equal number i.e. 100 houses are to be built on the given plot.

Minimum required number of columns of required strength, sizes & height capable of taking the load of the desired construction, to be laid at the determined points on the plot of land.

At a height of around 50 feet, a slab of maximum permissible area upto around 3600 sq. meters is to be laid on these columns with help of beams of required strength and sizes. Treating the slab area as a plot (artificially created plot) for one bungalow a compound, gates would be erected and trees, lawns are planted on soil beds on the slab. One house say B-1 of 125 sq. meters area is built on this slab (considering the slab area as an individual plot).

The columns are extended vertically and at a height of around 100 feet, another similar slab is laid providing similar compound, gates etc. with like trees and lawns—another house say B-2, is built considering such second slab as another independent plot for the second bungalow unit.

Likewise, houses say B-3, B-4, . . . B-25 are built on like slabs laid at 150 ft., 200 ft . . . , 2000 ft. At any point of height (horizontal level) there will be only one house with almost entire plot area (to be precise 10000-125) open around it.

Collectively, desired number of houses are built as per individual's requirements and choices, amongst specified models and designs, each on independent slabs, the artificially created plots provided with compounds, swimming pools, gates, trees, lawns and everything else as desired and meant for a luxurious bungalow.

Four such petals/wings each accommodating 25 houses, one above another, can be constructed alongside one another and all four wings would collectively accommodate 100 houses each of 125 sq. meters.

While first artificial plot i.e. slab of wing A will be at a height of 50 ft, that of wing B will be at a height of 62.5 ft, wing C at 75 ft and wing D at 87.5 ft. so that all houses would get arranged spirally. Sufficient vertical gap of 12.5 feet between the adjacent consecutive bungalows and the vertical gap of 50 feet between any two bungalows one above another will provide all the openness, full sunlight, all the illumination to each of the houses. The minimum gap of 12.5 feet would mean that at any point of height there would be only one house in the entire plot area and that thus, each house will have nearly 10,000 sq. meters of area open around it.

Each house will be on the artificially created independent plot i.e. the slab of the maximum permissible area up to around 3600 sq. meters which may even be as large as the total area of the given plot (in case of single petal construction). There would be everything on this artificial plot such as large sized lawns, gardens with different trees, kitchen gardens with several varieties of vegetables, swimming pool, badminton court, ample parking area, other trees, bushes, compound, gates . . . the works!

In the center of the four wings, there would be group of columns forming a conduit for staircases, elevators for persons, for goods and elevators also for vehicles. A road way can also be provided for vehicles. The vehicles can go right up to the topmost bungalow using the elevators or the road way.

All houses being at the height above 50 ft. right up to 1250 feet, will have heavenly view more that as from a high storied flat in a sky scraper.

Each house built as per the envisaged idea will be "Two-in-One" i.e. The mix of a Bungalow and a High storied dwelling in a skyscraper, together. Simply put, Enjoying the best qualities of a bungalow as well as a skyscraper-flat at the same time! Minus their respective shortcomings.

100 houses each of 125 sq. meters or 50 bungalows each of 250 sq. meters or 20 bungalows each of 625 sq. meters and for that matter any permutations and combinations are workable in this scheme! Very interestingly, with additional F.S.I. of 4 (four) being granted in constructions for rehabilitation of slums or redevelopment program, 2,000 houses each of 25 sq. meters or 1250 houses of 40 sq. meters can be constructed this way on the given plot. Dividing them into some houses for sale (so as to take care of entire construction cost including adequate arrangements for future maintenance etc.) and more number of more spacious houses for the poor slum dwellers is perfectly feasible. Needless to say, this would result not only in slum eradication but also in beautification of that locality and in creating heavenly homes for the poor! Considering the total elimination of congestion, the F.S.I. or the Development Control Regulations may not be applicable to construction done this way. Civic authorities may be satisfied about the major step in the envisaged way of construction towards striking the ecological balance and helping prevent global warming. If that be so, authorities may waive the restrictions, being in-applicable and any amount of construction is very much possible—vertical expansion in the true sense—making towns fully green and more beautiful!

| Description | Present day apartments/flats | Castles in the Air | |
|---|---|---|---|
| 1. Given plot area | 10,000 sq. meters. | 10,000 sq. meters. | |
| 2. Number of houses | 100 | 100 | |
| 3. Area to be left for Internal roads, lanes etc. | 500 sq. meters | 500 sq. meters | |
| 4. Area available for common use | 9,500 sq. meters | 9,500 sq. meters. | |
| 5. Plot area for each house | Nil | 120 to 3,600 sq. meters. | 1:36 |
| 6. Total Permissible construction including balconies, staircases, lifts etc. | 12,500 sq. meters | 12,500 sq. meters | |
| 7. Constructed area for each house | 125 sq. meters. | 125 sq. meters | |
| 8. Constructed area of each floor | 500 sq. meters. | 125 sq. meters. | 4:1 |

-continued

| Description | Present day apartments/flats | Castles in the Air | |
|---|---|---|---|
| 9. Open area for gardens, greenery | 2,000 sq. meters out of common area only | 3,59,500 sq. meters 100 × 3500 = 3,50,000 + common area 9,500 sq. meters. | 1:180 |
| 10. Parking space | 1 or 2 vehicles per house | Several number of vehicles for each house | |
| 11. Openness for each house | 2400 sq. meters. | 9,900 sq. meters. | 1:4 |
| 12. Protection shield From afternoon heat | Yes | Yes | |
| 13. Height at which houses are situated | 10 ft. to 250 ft. | 50 ft. to 1250 ft. | 1:5 |
| 14. Place for Solar panels | No | Ample | |
| 15. Windmills installation | Feasible in few cases | Feasible in all cases | |
| 16. Place for recreation | Available in confined place | Available in open as also in confined places | |
| 17. Feasibility of more Number of houses | Possible | Possible | |
| 18. Cost of construction For civil work per sq. meter | Rs. 10,000/= | Rs. 25,000/= i). for slab (artificial plot) area 5 times the BUA of house = 10,000/- per sq. meter BUA ii). For extended column height 5 times = 10,000/- per sq. meter BUA | 2:5 |
| 19. Cost for all other finishing & interior work, per sq. meter | Rs. 5,000/= | Rs. 5,000/= | same |
| 20. Total construction Cost, per sq. meter | Rs. 15,000/= | Rs. 30,000/= | 1:2 Rs. 15,000/= more per sq. meter |
| 21. Value, per sq. meter | Rs. 15,000/= + Land cost + Builder's all other expenses & profits | Rs. 30,000/= + Land cost + Builder's all other expenses & profits | |
| 22. Value per sq. meter at locality where land cost is Rs. 1,00,000/= per sq. meter | Rs. 1,15,000/= + Builders all other expenses & profits | Rs. 1,30,000/= + Builders all other expenses & profits | 100:113 Only around 13% more. |
| 23. Benefits | Usual | Large independent open plot for each house; More greenery, More openness & All the outstanding characters including all pleasures and facilities of a luxurious bungalow. | Un-comparable benefits. |
| 24. Sales prices | Usual under prevailing circumstances | House with large independent plot(open) of 150 sq. meters to 3600 sq. meters for each house will fetch higher prices from 133% to 1000% of price of equal size flat. | Increase in land area (all artificial plots together) & outstanding characters of houses will have great impact on prices. |

The architectural structure in accordance with this invention and the method of making this structure combines the benefits of both a bungalow and a high rise apartment and at the same time eliminating the limitations of both conventional structures.

While considerable emphasis has been placed herein on the particular features of the preferred embodiment and the improvisation with regards to it, it will be appreciated that various modifications can be made in the preferred embodiments without departing from the principles of the invention. These and the other modifications in the nature of the invention will be apparent to those skilled in art from disclosure herein, whereby it is to be distinctly understood that the foregoing descriptive matter is to interpreted merely as illustrative of the invention and not as a limitation.

The invention claimed is:

1. An architectural structure comprising, at least one core column structure;

a plurality of recessed platform structures successively extending operatively orthogonally from said column structure and supported thereby, said successive platform structures spaced apart vertically and horizontally from each other so that each of the platforms is adapted to receive adequate sunlight and ventilation independently and an unobstructed scenic view;

landfill which includes an aggregate of stones, gravel, soil and clay, filled in said recesses of the recessed platforms to form plots;

water reticulation systems provided in at least some of said platforms connected with each other and to a central water supply system, said water reticulation system including treatment plants for treatment of water after use at each plot and providing the treated water to a plot at an operatively lower level;

access means, including staircases, escalators, roadways, ramps and lifts, connecting the plots with the ground level and with other plots;

amenities/utilities provided to at least some of said plots, and a fencing provided around the plot of each platform, the fencing adapted to collect rain water and supply the collected rain water to the water reticulation system, the fencing having a series of flaps which at appropriate times can be folded or unfolded so that the fencing acts as a receptacle for rain water and feeds the collected rainwater to the water reticulation system, wherein the water reticulation system includes a perforated plate provided spaced apart from the base of the recess in said platform, forming a space between said plate and the recess for collection of the water percolated through the landfill;

wherein each of said platforms is provided around the core column in the form of a petal formation and disposed at different elevated levels, each of the platforms being on a respectively different vertical level from the other platforms, each of the platforms being offset horizontally with respect to adjacent platforms, and each of the platforms being positioned in a superimposed relationship with another platform that is multiple levels apart from the respective platform.

2. An architectural structure as claimed in claim 1 wherein, each of the platforms is provided with a protective fencing and a security fencing at least at one level extending from the outer side of the platform to prevent any object from falling down.

3. An architectural structure as claimed in claim 1 wherein, the core column structure is selected between hollow and solid and includes support columns which are hollow.

4. An architectural structure as claimed in claim 1 wherein, said column structure encloses the access means and provides conduits for the water supply system, amenities and utilities.

5. An architectural structure as claimed in claim 1 wherein, said landfill includes material which is graded into top soil, sub soil and earth containing stones, gravel, soil and clay.

6. An architectural structure as claimed in claim 1 wherein, said landfill includes segments of landfill made by compacting stones, gravel, soil and clay together off site and transported to site for filling the recesses.

7. An architectural structure as claimed in claim 1 wherein, the water reticulation system includes means to collect water percolated through at least some of the plots and supply the collected water to a plot at a lower level.

8. An architectural structure as claimed in claim 1 wherein, the water reticulation system includes pumping means to pump water collected at the lowermost plot up to the top of the structure for re use after a final treatment.

9. An architectural structure as claimed in claim 1 wherein, the water reticulation system includes means to monitor the quality of the water to be supplied and means to divert water for further treatment if not found satisfactory for use.

10. An architectural structure as claimed in claim 1 wherein, the water reticulation system includes a solid waste management which includes a compost pit located at ground level to receive solid waste from the treatment plants in the system.

11. An architectural structure as claimed in claim 1 wherein, at least one housing structure is constructed on some of the said plots; said housing structure selected from a group of housing structures consisting of a dwelling, a bungalow, a club, an educational structure, a shop, a parking lot, a recreational facility, a gym, a playing ground, a power plant, a wind mill, and a library.

12. An architectural structure as claimed in claim 1 wherein, the said central or support column forms part of the housing structure built around it.

13. An architectural structure as claimed in claim 1 wherein, said housing structures on different plots do not share a common floor or roof.

14. An architectural structure as claimed in claim 1 wherein, at least some of said plots are adapted for use for agricultural, horticultural, landscaped garden, park, recreational, and sporting use and the water reticulation system includes a drip irrigation system passing through the landfill in the plots.

15. A method of creating an architectural structure, said method comprising the steps of:

constructing at least one column structure;

constructing a plurality of recessed platform structures successively extending in an operative horizontal position from said column structure and supported thereby, said successive platform structures being spaced apart vertically and horizontally from each other so that each of the platforms is adapted to receive adequate sunlight and ventilation independently and an unobstructed scenic view;

filling the recesses in said recessed platforms with a soil bed to form plots, wherein said soil is an aggregate of soil, clay, gravel and stones;

constructing housing structures on at least some of said plots;

providing a water reticulation system for at least some of said plots connecting water reticulation system in said plots to each other and to a central water supply system;

recycling water after treatment and separation of solid waste from plot to plot and using the recycled water from a plot at a higher level, at a plot at a relatively lower level;

providing means to access said plots from the ground level and from other plots;

providing amenities/utilities to at least some of said plots; and providing a fencing around the plot of each platform, the fencing adapted to collect rain water and supply the collected rain water to the water reticulation system, the fencing having a series of flaps which at appropriate times can be folded or unfolded so that the fencing acts as a receptacle for rain water and feeds the collected rainwater to the water reticulation system, wherein the water reticulation system includes a perforated plate provided spaced apart from the base of the recess in said platform, forming a space between said plate and the recess for collection of the water percolated through the landfill;

wherein each of the platforms is on a respectively different vertical level from the other platforms, each of the platforms being offset horizontally with respect to adjacent platforms, and each of the platforms being positioned in a superimposed relationship with another platform that is multiple levels apart from the respective platform.

16. A method for creating an architectural structure as claimed in claim 15 wherein said method includes providing support structures, such as beams, trusses and support columns for supporting the plots.

17. A method for creating an architectural structure as claimed in claim 15 wherein said method includes creating a gap at the base of each platform for collecting water percolated through the land fill in the platform and connecting the gap to the water reticulation system.

18. A method for creating an architectural structure as claimed in claim 15 wherein said soil bed is prepared in the recess by filling the recess with soil, clay, gravel and stones in a graded manner.

19. A method for creating an architectural structure as claimed in claim 15 which includes the step of constructing plots starting from a height of around 10 meters to around 30 meters for free movements of people, vehicles and for other public uses as vehicle parking, parks below the architectural structure.

20. A method for creating an architectural structure as claimed in claim 15 wherein the method includes constructing said housing structures or on said plots by incorporating the columns within the housing structure.

21. A method for creating an architectural structure as claimed in claim 15 wherein the method includes constructing a dwelling space surrounded by a landscaped garden on said plot.

22. A method for creating an architectural structure as claimed in claim 15 wherein said method includes providing solar panels mounted on the plots, and around the plots for generating electricity; generating electricity therefrom and using said electricity in the housing structures on said plots and for the water reticulation system.

23. A method for creating elevated plots as claimed in claim 15 wherein the method includes providing means for harvesting of rain water and storing said rainwater in holding tanks for later use.

24. A method for creating an architectural structure as claimed in claim 15 wherein series of such structures are connected by roadways, lanes at a height of 30 meters, and again at a height of 60 meters and so on, creating "Sky-villages".

* * * * *